US008684182B2

(12) United States Patent
Bailey

(10) Patent No.: US 8,684,182 B2
(45) Date of Patent: Apr. 1, 2014

(54) PACKAGE STANDING FEATURE UTILIZING BLISTER AND PAPERBOARD

(75) Inventor: Ryan A Bailey, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 236 days.

(21) Appl. No.: 13/133,679

(22) PCT Filed: Dec. 7, 2009

(86) PCT No.: PCT/US2009/067004

§ 371 (c)(1), (2), (4) Date: Jun. 9, 2011

(87) PCT Pub. No.: WO2010/068593

PCT Pub. Date: Jun. 17, 2010

(65) Prior Publication Data

US 2011/0240503 A1 Oct. 6, 2011

Related U.S. Application Data

(60) Provisional application No. 61/122,104, filed on Dec. 12, 2008.

(51) Int. Cl.
*B65D 75/36* (2006.01)
*B65D 73/00* (2006.01)

(52) U.S. Cl.
USPC ..... 206/463; 206/45.24; 206/462

(58) Field of Classification Search
USPC ..... 206/463, 462, 470, 45.24, 469, 471, 206/461, 736, 45.2
See application file for complete search history.

(56) References Cited

U.S. PATENT DOCUMENTS

| | | | | | |
|---|---|---|---|---|---|
| 3,203,542 | A | * | 8/1965 | Lightner et al. | 206/463 |
| 3,314,535 | A | * | 4/1967 | Jarecki | 206/489 |
| 3,407,928 | A | * | 10/1968 | Watts, Jr. | 206/463 |
| 3,685,649 | A | * | 8/1972 | Diehl | 206/45.24 |
| 3,847,282 | A | * | 11/1974 | Collura et al. | 206/782 |
| 4,083,451 | A | | 4/1978 | Hair | |
| 4,236,637 | A | * | 12/1980 | Castner et al. | 206/467 |
| 4,415,084 | A | | 11/1983 | Hauser et al. | |
| 4,549,654 | A | | 10/1985 | Tiesman | |
| 4,702,368 | A | * | 10/1987 | Jones | 206/45.24 |
| 4,784,268 | A | * | 11/1988 | Perchak | 206/461 |
| 4,880,112 | A | * | 11/1989 | Conrad | 206/216 |
| 4,930,627 | A | * | 6/1990 | Borst et al. | 206/45.23 |
| 4,962,849 | A | * | 10/1990 | Anderson | 206/45.24 |
| 5,011,006 | A | * | 4/1991 | Anderson | 206/45.24 |
| 5,129,516 | A | | 7/1992 | Theros | |
| 5,147,035 | A | * | 9/1992 | Hartman | 206/45.23 |

(Continued)

FOREIGN PATENT DOCUMENTS

WO WO2006099201 A1 9/2006

OTHER PUBLICATIONS

International Search Report for PCT/US2009/067004, Nov. 30, 2010.

(Continued)

*Primary Examiner* — Steven A. Reynolds
(74) *Attorney, Agent, or Firm* — MWV Intellectual Property Group

(57) ABSTRACT

A package is disclosed including a blister and a folded paperboard card, and having features that provide for the package to be displayed in a self-standing configuration.

9 Claims, 19 Drawing Sheets

(56) References Cited

U.S. PATENT DOCUMENTS

| | | | | |
|---|---|---|---|---|
| 6,092,664 | A * | 7/2000 | Bartosek | 206/784 |
| 6,279,746 | B1 * | 8/2001 | Hussaini et al. | 206/470 |
| 6,330,945 | B1 | 12/2001 | Reimer | |
| 6,401,932 | B1 * | 6/2002 | Weinstein et al. | 206/779 |
| 7,353,948 | B1 | 4/2008 | McDonald | |
| 7,413,080 | B2 | 8/2008 | Van House | |
| 7,621,405 | B2 * | 11/2009 | Schweitzer et al. | 206/703 |
| 7,624,859 | B1 * | 12/2009 | Casanova et al. | 206/45.24 |
| 7,931,147 | B2 * | 4/2011 | Petrelli et al. | 206/464 |
| 8,056,721 | B2 * | 11/2011 | Hession | 206/461 |
| 8,146,745 | B2 * | 4/2012 | Burress et al. | 206/462 |
| 2006/0016717 | A1 | 1/2006 | Ritter | |
| 2007/0029223 | A1 | 2/2007 | Mazurek | |
| 2007/0114153 | A1 * | 5/2007 | Ritter | 206/462 |
| 2007/0187264 | A1 * | 8/2007 | Hofte et al. | 206/45.24 |
| 2007/0209957 | A1 * | 9/2007 | Glenn et al. | 206/462 |
| 2008/0217199 | A1 * | 9/2008 | Burress et al. | 206/470 |
| 2008/0283435 | A1 | 11/2008 | Morgan | |
| 2009/0272670 | A1 * | 11/2009 | Petrelli et al. | 206/736 |
| 2011/0000811 | A1 | 1/2011 | Dayan et al. | |

OTHER PUBLICATIONS

International Preliminary Report on Patentability for PCT/US2009/067004, Jun. 14, 2011.

* cited by examiner

FIG. 1C
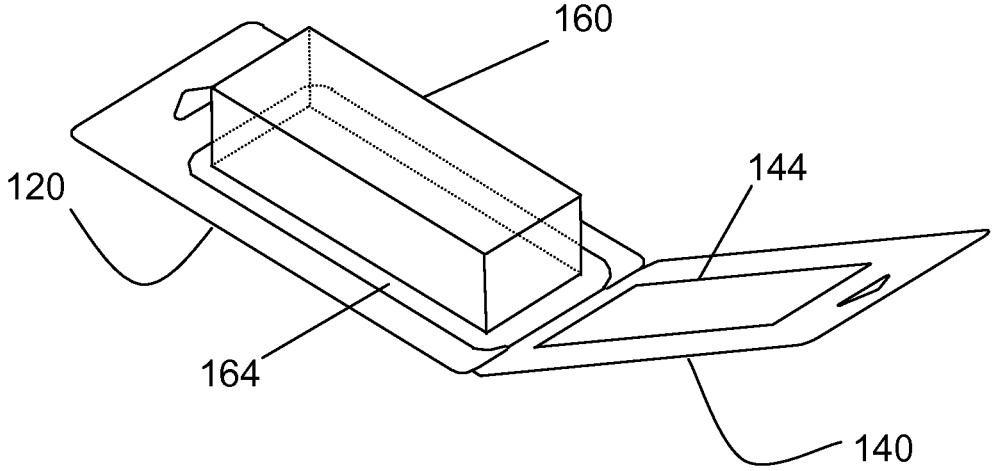
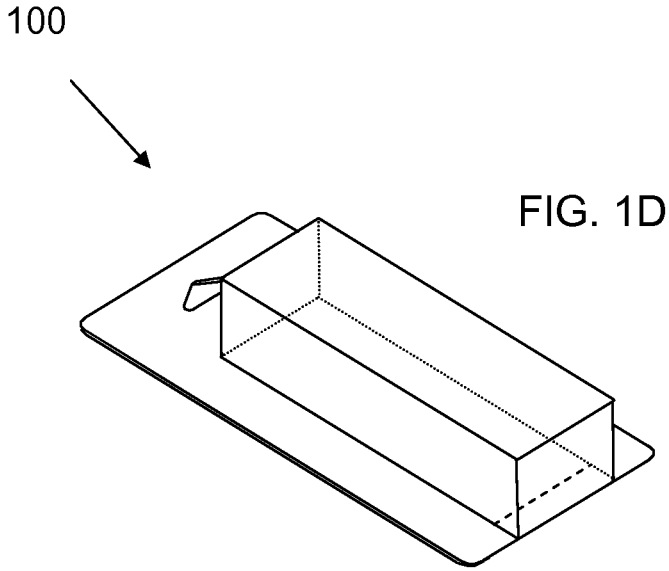
FIG. 1D

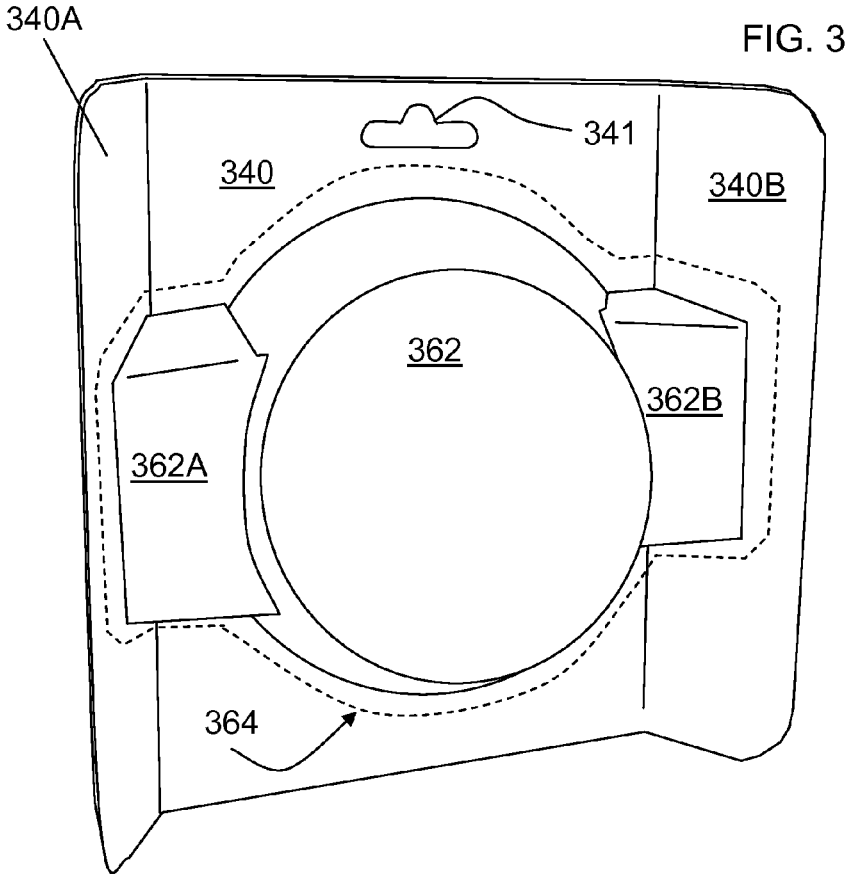
FIG. 3B
FIG. 3C
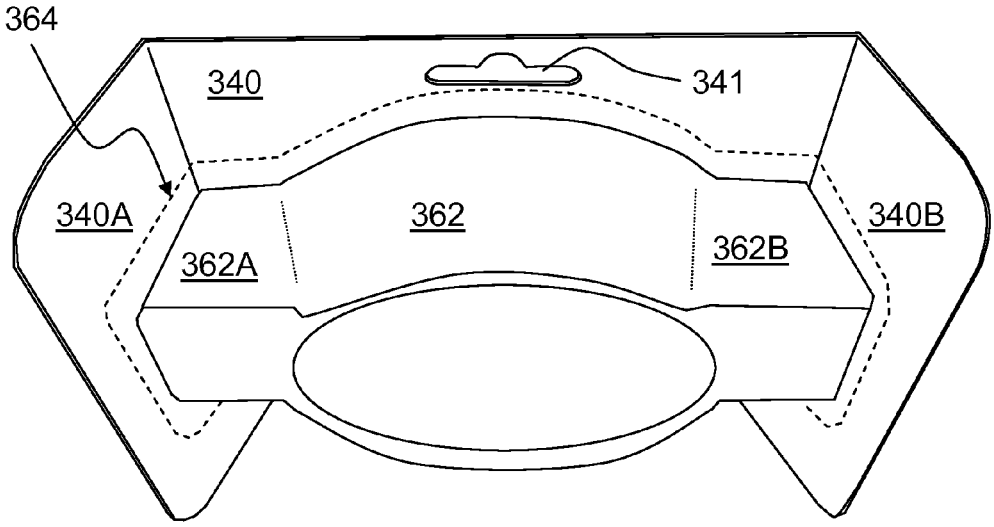

PACKAGE STANDING FEATURE UTILIZING BLISTER AND PAPERBOARD

REFERENCE TO RELATED APPLICATION

This application is a National Phase entry into the United States and claims the benefit of PCT/US09/67004, filed Dec. 7, 2009, which claims the benefit of priority under 35 U.S.C. §119(e) of provisional application Ser. No. 61/122,104 filed on Dec. 12, 2008; and incorporates each of these applications herein by reference in their entireties.

BACKGROUND

The present application is directed to paperboard packages and, more particularly, to self-standing features for paperboard packages.

Manufacturers and retailers of consumer goods, such as pharmaceuticals, software, electronics, health and beauty products and the like, typically package their products in tamper resistant security packages. For example, many consumer goods are packaged in blister or clamshell packages formed by positioning a consumer good in a flanged blister made from various polymeric and/or paperboard materials and sealing the flanged blister between two paperboard substrates. Consumers have voiced disapproval of such packages because of the difficulty of opening the same and the potential for being cut on a rough edge especially of plastic blisters. Packages may therefore be made based largely on paperboard, for example, NATRALOCK packages. Packaging made primarily of paperboard is more sustainable than packaging made from petroleum-based plastics. The paperboard used in such packages may be tear-resistant as described in commonly assigned U.S. Pat. No. 7,144,635.

Some blister packages may comprise a paperboard card and a blister. Such a package may be suitable for display by hanging from a hook, but may not be well adapted for display in a standing configuration. Accordingly, there is a need for a blister package that provides a convenient feature for displaying the package in a standing configuration.

SUMMARY

In one aspect a packaging structure is disclosed which comprises a first panel and a second panel comprised of sheet material, and a first blister comprising a flange, wherein the first blister is sealed to at least one of the panels, and wherein the first panel and the second panel are connected at a first angle along a first fold line.

Other aspects of the disclosed packaging structures will become apparent from the following description and the accompanying drawings.

BRIEF DESCRIPTION OF THE DRAWINGS

FIG. 1C is a side perspective view of a partially package made from the blank and blister of FIG. 1B;

FIG. 1D is a side perspective view of a completed package made from the blank and blister of FIG. 1B;

FIG. 3B is a side perspective view of a package made from the parts of FIG. 3A;

FIG. 3C is a top perspective view of a package made from the parts of FIG. 3A;

DETAILED DESCRIPTION

Figure 1A:
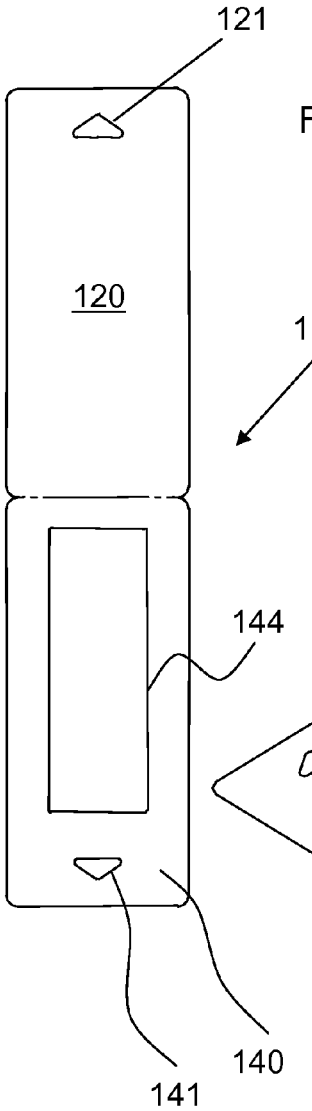
FIG. 1A is a top plan view of a blank for a packaging structure.
Figure 1B:
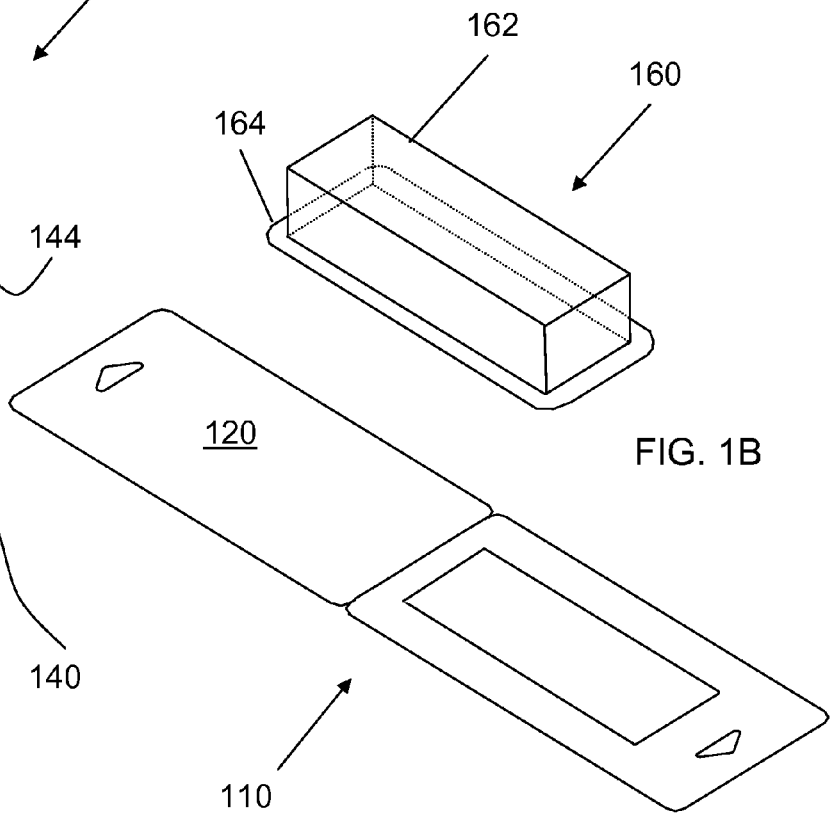
FIG. 1B is a side perspective view of the blank of FIG. 1A, along with a blister to fit therein.
Figures 2A, 2B:
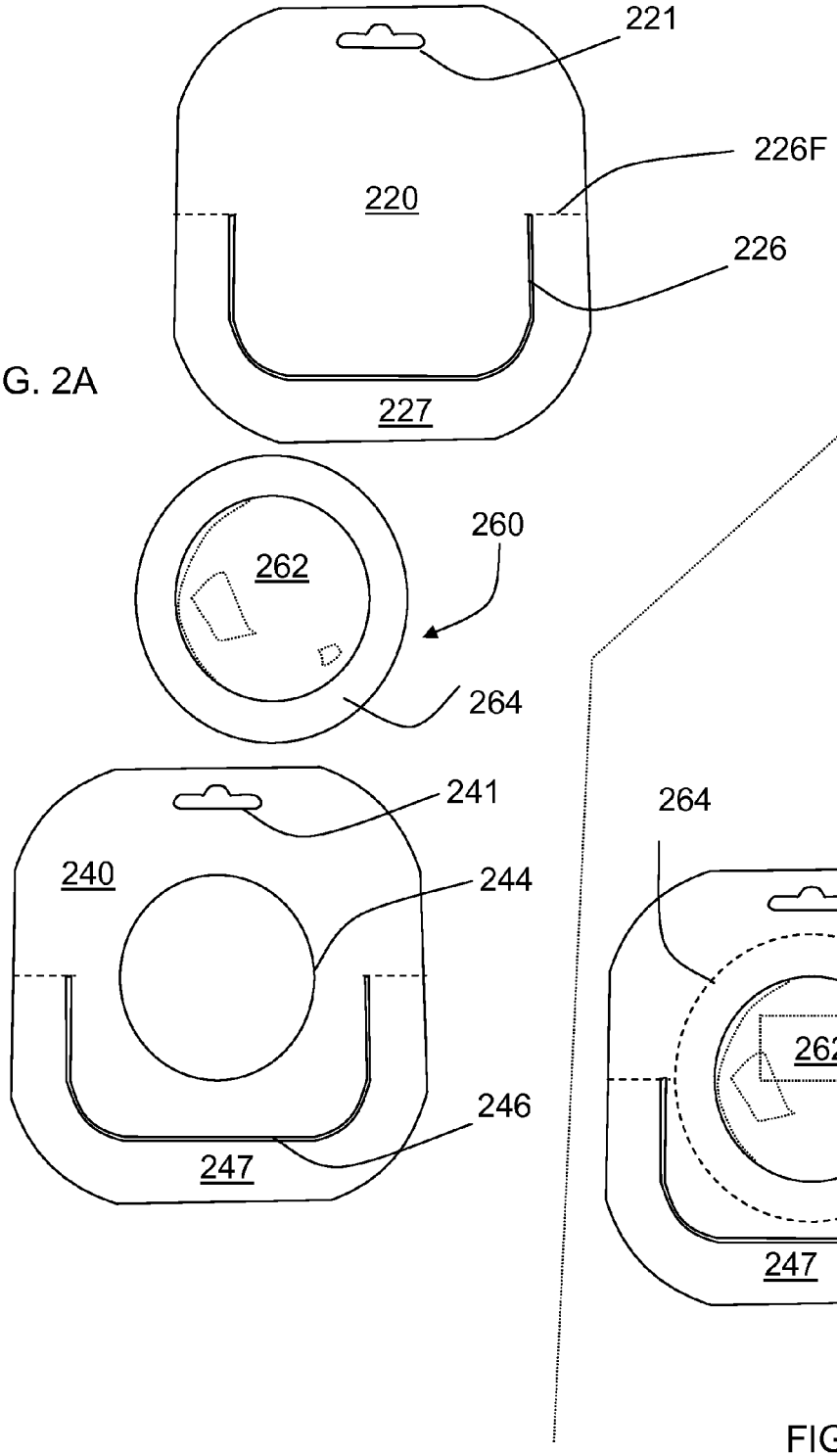
FIG. 2A is a top plan view of parts for another packaging structure.
FIG. 2B is a top view of a package made from the blanks of FIG. 2A.
Figure 2C:
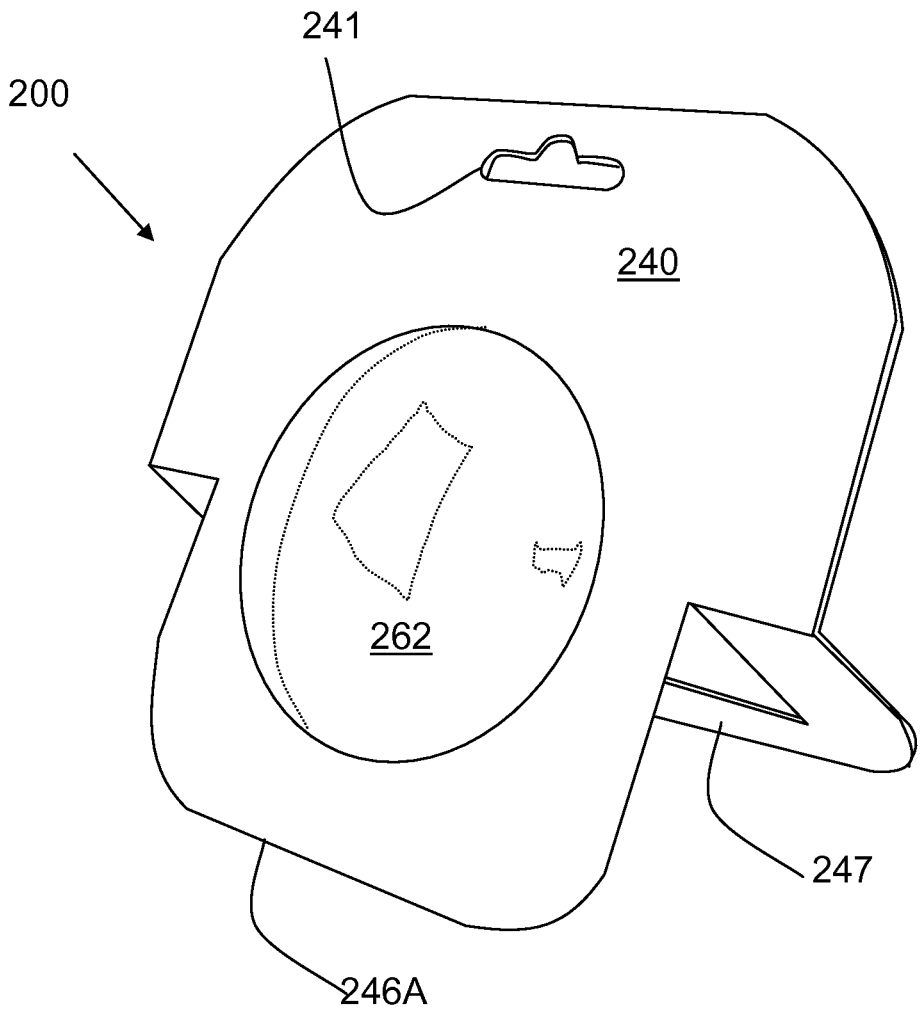
FIG. 2C is a side perspective view of the package of FIG. 2B, arranged to a standing configuration.

As various embodiments of the security package are described, reference will be made to FIGS. 1-8. Certain parts of the packages are denoted by reference numerals. Where there is more than one of the same feature, generally only one will be denoted by a reference numeral. If different packages have a common feature, it may only be described one time. Common features, where practical, are denoted with similar numerals differing by the 'hundreds' digit. For example the back panel shown in FIG. 1A-1D is back panel 120; while the back panel shown in FIG. 2A-2C is back panel 220. Typically in these Figures, where a top plan view is shown for a blank of material, solid lines indicate periphery or cuts, and dashed lines indicate crease, score, or fold lines. In perspective views, solid lines typically show edges, while dashed lines typically show hidden or partially obscured features. Where assembly steps are described, these steps are exemplary and are not to be limiting as to the sequence of operations used to arrive at the final package. Also, directions such as up, down, top, bottom, front, back, etc. are used for convenience in describing the package and are not meant to be limiting. In most cases the packages described here are made from one or several blanks (that is, the cut sheet parts from which the package components are made by folding and other steps). However, it should be understood that certain unitary blanks may be provided instead as more than one part, and certain blanks may be combined into single blanks, while still arriving at the same finished package. The word "panel" will often be used to describe a piece of sheet material such as paperboard, particularly with respect to a blank from which the package is made. However, "panel" may also be used to describe a region of a piece of material, for example a portion of the material that is in a first plane, connected across a fold line with the same material in a second plane. Since panels are sometimes superimposed, for example, creating a two-layer structure, like features or panels will sometime coincide, in which cases, descriptions may call out the number identifying the feature closer to the viewer, that is, the feature visible in a particular Figure.

Paperboard security packages, such as blister packages, are well known by those skilled in the art. FIGS. 1A and 1B show plan and perspective views, respectively, of a card 110 for forming a known security package, for example as described in U.S. patent application Ser. No. 11/924,750. Also shown is a blister 160 to fit within the card. The blister may be a recycled material such as RPET or a biodegradable material such as PLA. The card may have a back panel 120 and a front panel 140 and one or both of these panels may comprise a hang hole 121, 141. If both panels have hang holes, they may overlap to provide two layers of material to reinforce the hang hole and surrounding area. A reinforcing layer of paperboard or other material may be placed between the front and back panel, for example at the hang hole location, as described in PCT/US08/066,517. The front panel may have an aperture 144 to receive the body 162 of blister 160. Blister 160 may have a flange 164 to be sealably received between the back panel 120 and front panel 140.

FIG. 1C shows a perspective view of the package in a partially assembled configuration, with blister 160 placed upon back panel 120, and front panel 140 in the process of being folded over the blister and back panel. As seen in FIG. 1C, and also in the finished package 100 of FIG. 1D, the body of blister 160 fits in aperture 144, while the flange 164 becomes sandwiched between front panel 140 and back panel 120.

The card 110 (and other cards, sleeves, liners, wraps, etc described herein) may be formed of a sheet material such as paperboard, which may be made of or coated with materials to increase its strength. An example of such a sheet material is EASYSEAL paperboard made by MeadWestvaco Corporation. The sheet material may have a heat sealable coating, for example to allow a heat seal to be created between the back panel 120 and front panel 140. Alternately, other forms of adhesive may be used to seal these panels together. It should be noted that the use of tear resistant materials, and/or in more than one layer, help to improve the tamper- and theft-resistance of the package.

Package 100 may be used to enclose either a loose item of merchandise, or an inner carton enclosing merchandise. For example, a manufacturer may have an existing well established carton with a well-recognized brand image, but lacking adequate security. Such a carton may have a premium appearance, for example custom graphics, metallization, embossing, or other premium features. By placing the existing premium carton inside the security package, tamper and theft resistance are provided. Furthermore once the security package is opened (which may destroy the security package) the premium package is still intact. Thus a manufacturer may wish to enclose an existing carton within package 100, or any of the other security packages described herein.

The following packages and blanks disclosed in this application teach modifications on the standard paperboard blister packages. The disclosed modifications teach improved standing features for a paperboard based package. It is to be understood that a variety of materials may be used to form these packages. However, for sustainability purposes, a paperboard based material may be used and for improved theft deterrence a tear resistant paperboard may be used. The standing features described in this application may be used alone or in combination with other package features.

FIG. 2A shows a plan view of parts for forming a standing package, and FIG. 2B shows a plan view of the finished package 200. The parts of this package may include a back panel 220, a front panel 240, and a blister 260. Front panel 240 may comprise an aperture 244 through which the blister body 262 may protrude, while blister flange 264 may be sandwiched between back panel 220 and front panel 240. The adjoining surfaces of front panel 240 and back panel 220 may be adhered together by heat sealing, gluing, or other adhesive. An additional blister (not shown) could be provided along with an aperture (not shown) in the back panel, to extend the blister cavity through to the back of the package as shown in some of the following examples. Alternately such a back blister might be provided along with a planar transparent front window in place of blister 260, allowing contents to be seen from the front but contained behind the plane of front panel 240.

Back panel 220 and front panel 240 may, for example, be paperboard. The panels are shown with substantially the same perimeter, which may yield a package comprised of two layers of paperboard. However, portions of the package might only be single ply. A more secure package may result if the blister flange 264 is sandwiched between two layers of material. One or both plies may comprise hang hole 221, 241. Back panel 220 and front panel 240 may comprise cut lines 226, 246 delineating leg panels 227, 247 that may be hingedly folded relative to the package, for example along fold lines such as 226F.

FIG. 2C shows package 200 with leg panels 227, 247 folded back so that the package stands on the back-folded leg panels and on the lower edge 246A. To save shipping space, the package may be shipped flat and have the leg panel 227, 247 folded at the point of sale. If leg panels 227, 247 are not two layers (that is, if only leg panel 227 or only leg panel 247 is provided) such a standing configuration may still be achieved with a single layer leg panel. Alternately leg panels 227, 247 may be provided but not adhered together, in which case, for example, leg panel 227 may be folded back while leg panel 247 remains unfolded. The location and shape of cut lines 226, 246 and the resulting leg panels 227, 247 may be designed so that the center of gravity of the finished package 200 falls between the edge 246A and the bottom of folded leg panel 247, 227, providing a stable support for the package. Alternately package 200 may be displayed hanging from hang hole 241.

Heat sealing may be accomplished by use of both heat and pressure. Heat sealing may be used at the juncture of blister flange 264 with the front panel 240 and back panel 220. Heat sealing may also be used along the periphery of front panel 240 and back panel 220. Alternately heat sealing may be used on the entire adjoining surfaces of front panel 240 and back panel 220, including the blister flange 264.

In another embodiment, the package may be made of only one layer of paperboard, for example by attaching blister 260 to back panel 220 by heat sealing, glue, staples, or other means, and omitting front panel 240.

Figure 3A:
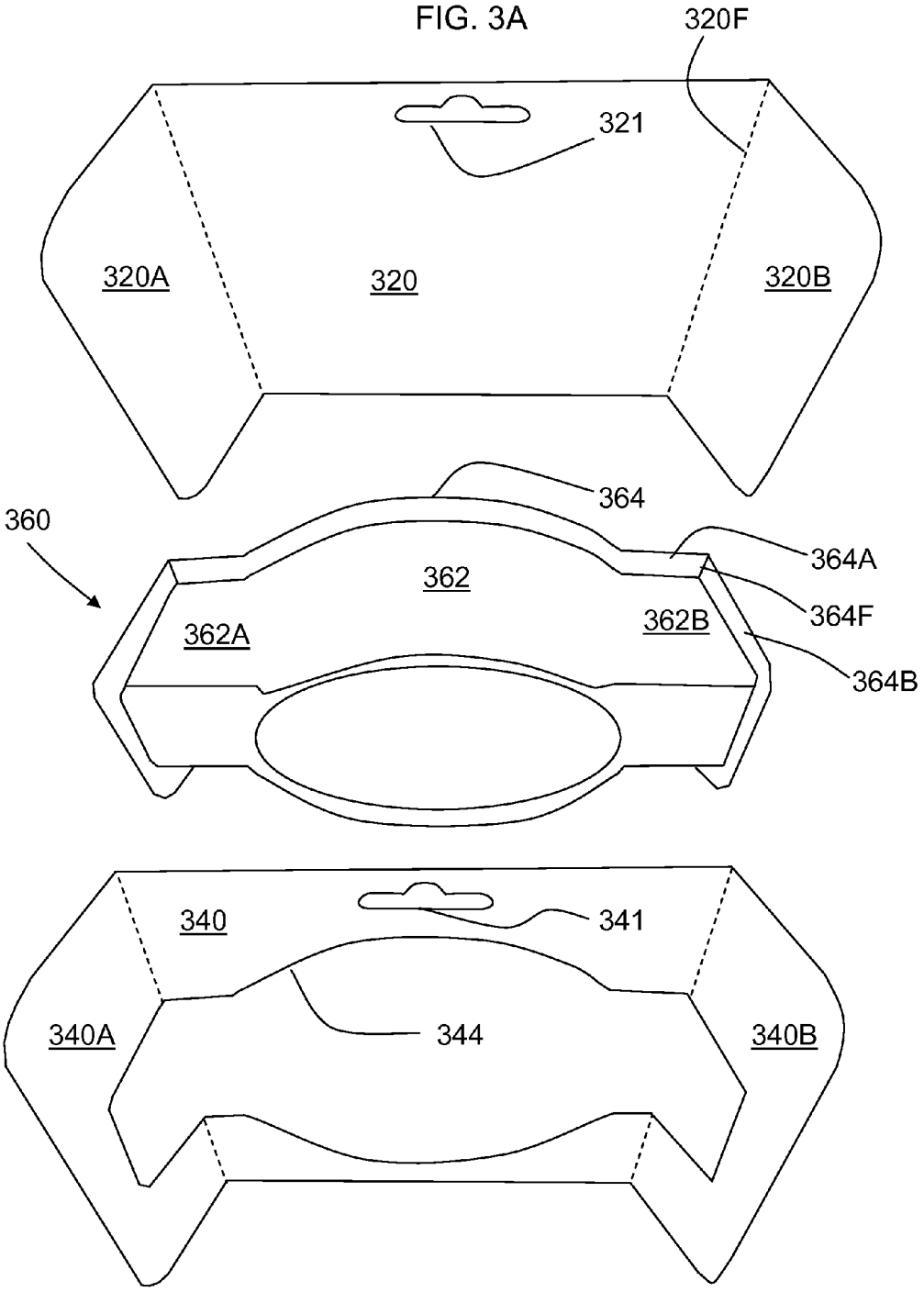
FIG. 3A is a perspective view of parts for another packaging structure.

FIG. 3A shows a perspective view of parts for forming another standing package. The parts may include back panel 320 with back side panels 320A, 320B; a front panel 340 with front side panels 340A, 340B, and a blister 360 with a main blister cavity 362 and blister side wings 362A, 362B. One or both of the front and back panels may comprise a hang hole 321, 341. If both panels have a hang hole, they may overlap to reinforce the hang hole and the surrounding area. The front and back panel may be provided with fold, crease or score lines (generally shown, with fold line 320F enumerated as an example). Blister 360 may be provided with blister flange 364 that may be sandwiched from behind by back panel 320 and back side panels 320A, 320B; and from in front by front panel 340 and front side panels 340A, 340B. Aperture 344 may be provided in front panel 340 through which blister 360 may protrude. Blister flange 364 while being generally flat may lie in more than one plane. For example, flange portions 364A and 364B may intersect in a flange fold 364F. The shape of the blister flange 364, including one or more flange folds, may be used to help retain the finished package in a particular shape.

FIGS. 3B and 3C show the assembled package in front perspective and top perspective views. The (now hidden) blister flange 364 is shown (dashed lines) sandwiched between the layers of the front panel and back panel. The shape of the flange holds the side panels (e.g. front side panels 340A, 340B and back side panels 320A, 320B) in a self-standing configuration. The particular angle of the side panels to the front panel 340 and back panel 320 may be controlled by the design of blister 360 and its flange 364. This angle, along with the size of the side panels relative to the package and the blister, may be chosen so that the center of gravity of the finished package falls within the "footprint" defined by the front/back panel and the side panels. Thus the package will stand upright and stable. Alternately the package may be displayed hanging from hang hole 341.

In another embodiment the package may be made of only one layer of paperboard, for example by attaching blister 360 to back panel 320 by heat sealing, glue, staples, or other means, and omitting front panel 340.

It is to be understood that the hang tab may comprise two or more layers of material. It is to be understood that the hang tab may comprise three or more layers of material. It is to be understood that the exact dimensions of the package may be adjusted based on manufacturing preferences. In addition, fold-over panels may be provided on some paperboard panels to strengthen certain areas, for example the hang tab, by adding one or more layers. In such an instance a heavier product may be contained within the package without risk of the hang tab tearing or breaking. These packages may be formed from more than one blank of paperboard material, or the blanks may in some cases be combined. In some cases, the packages may be formed from a single blank of paperboard material. In some cases, the packages may be formed using a single layer of paperboard material.

Fold lines in certain of the package designs may provide an area through which to initiate a tear. To help prevent such a tear or keep it from breaching the blister, stress diverter features (not shown) may be provided such as shaped openings along a fold line to divert a tear away from the blister. One or more layers of the paperboard (any in any of the packages) may have one or more overt (visible) or hidden features to help deflect any initiated tear back toward the outside periphery of the package, or otherwise away from the contents. For example, partially-cut lines may be made into a hidden surface such as the inward-facing surface of the front panel or back panel, so that if a tear is initiated, the hidden partially-cut line may divert the tear back toward the edge of the package. Such tear-diverting features are described in U.S. Provisional Application No. 61/081,404.

A tear proof material such as DURAFOLD paperboard will usually need to be opened using a tool such as a knife or scissors. Tear resistant material such as NATRALOCK may be provided with overt or hidden features to assist a customer in opening the package, as described in U.S. Provisional Application No. 61/025,102. Such opening features may be incorporated in any of the packages disclosed herein.

Figure 4A:
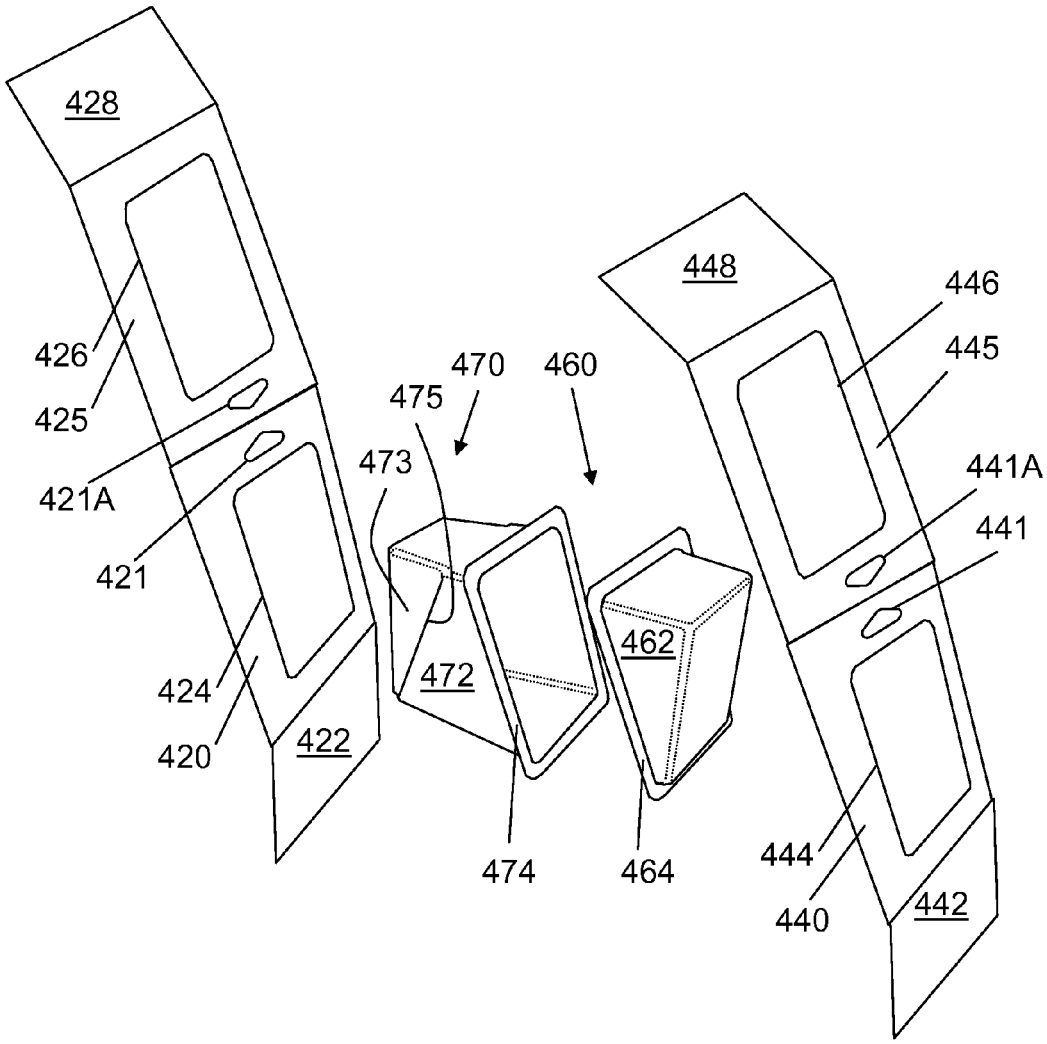
FIG. 4A is a side perspective view of the parts for another packaging structure.

FIG. 4A shows a side perspective view of parts for forming another standing package. The parts may include a back panel 420 with back extension panel 425 and back terminal panels 422, 428. The parts may further include a front panel 440 with front extension panel 445 and front terminal panels 442, 448. The terms "back" and "front" are not meant to be limiting. As will be seen with the finished package, back panels 420, etc. might also be considered "inner" panels, while front panels 440, etc. might also be considered "outer" panels. The front and back panels may comprise hang holes 421, 421A, 441, 441A. The package may also comprise front blister 460 with blister body 462 and blister flange 464. The package may also comprise back blister 470 with blister body 472, blister flange 474, detent feature 475, and narrowed portion 473. Detent feature 475 may for example be a groove, rib, ridge, one or more bumps, or other shape feature capable of interacting with an edge of the paperboard or opening in the paperboard such as aperture 426, 446.

The front panel 440 and back panel 420, and their attached panels, may be identical or nearly identical as shown in FIG. 4A, thus resulting in a package whose paperboard components are for the most part two-layer. However, certain of the paperboard panels may be omitted, resulting in a package with some single layer areas. It may be advantageous for at least front panel 440 and back panel 420 to be provided so that blister flanges 464, 474 may be sandwiched between layers of paperboard as shown.

Figure 4B:
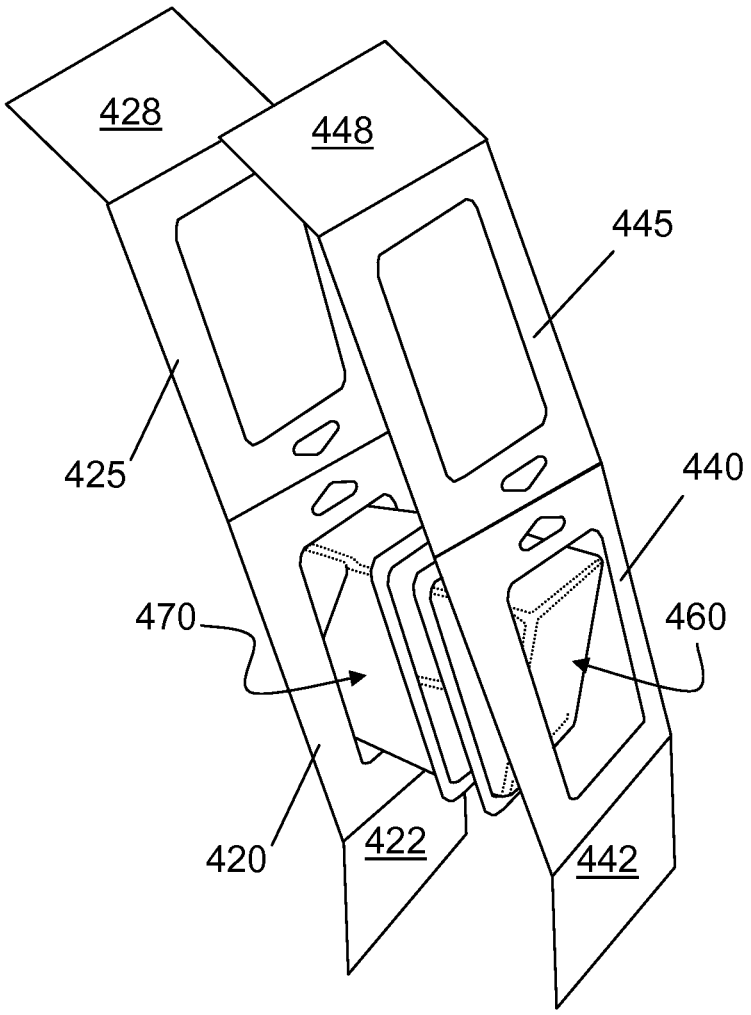
FIG. 4B is a side perspective view of the parts of FIG. 4A, in a stage of assembly.

FIG. 4B shows a side perspective view of the package in a partly assembled configuration. It is seen that blister body 462 of blister 460 may fit through aperture 444 in front panel 440, while blister body 472 of blister 470 may fit through aperture 424 in back panel 420.

Figure 4C:
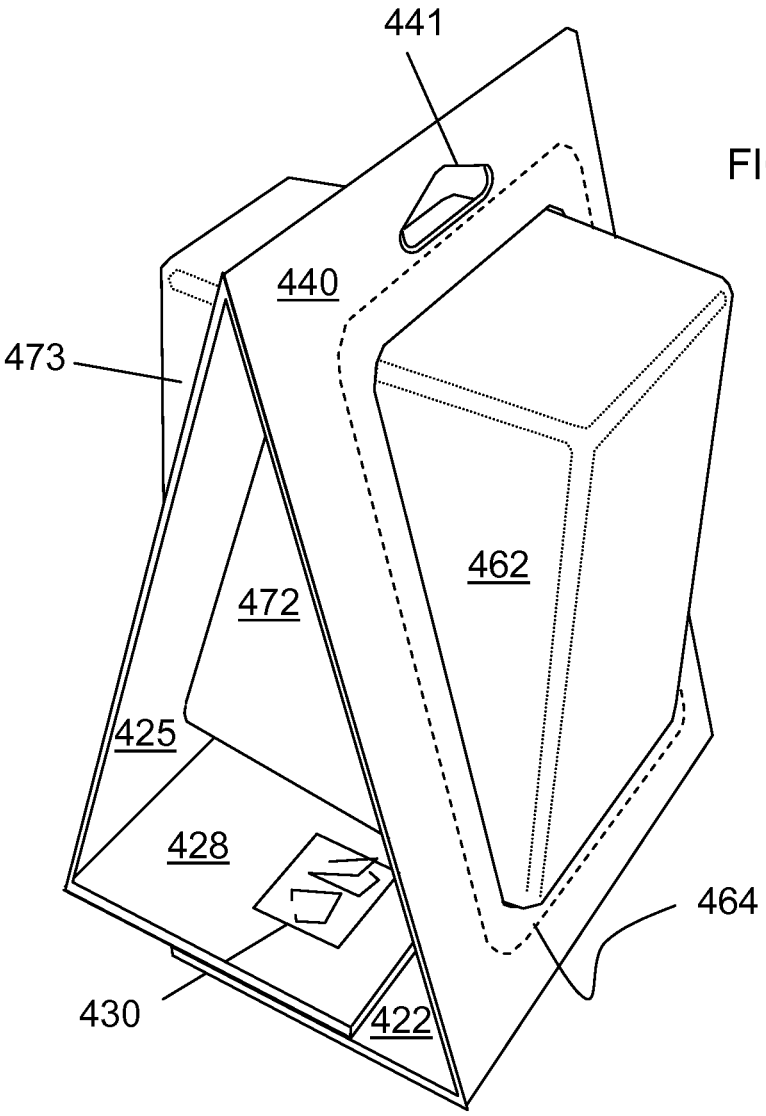
FIG. 4C is a side perspective view of a packaging structure made from the parts of FIG. 4A.

FIG. 4C shows the finished package, which may have an approximately triangular shape, with front panel 440 (obscured) back panel 420 forming one leg of the shape, lateral wall, while (obscured) front extension panel 445 and back extension panel 425 form the other leg of the triangular shape. Meanwhile front terminal panel 442 (obscured) and back terminal panel 422 may overlap front terminal panel 448 (obscured) and back terminal panel 428, to form the based of the shape. Interlocking features 430 may be provided in the terminal panels 422, 428, 442, 448. Such features may include locking tabs, fingers, holes, adhesives, etc. as are known in the art.

Figure 4D:
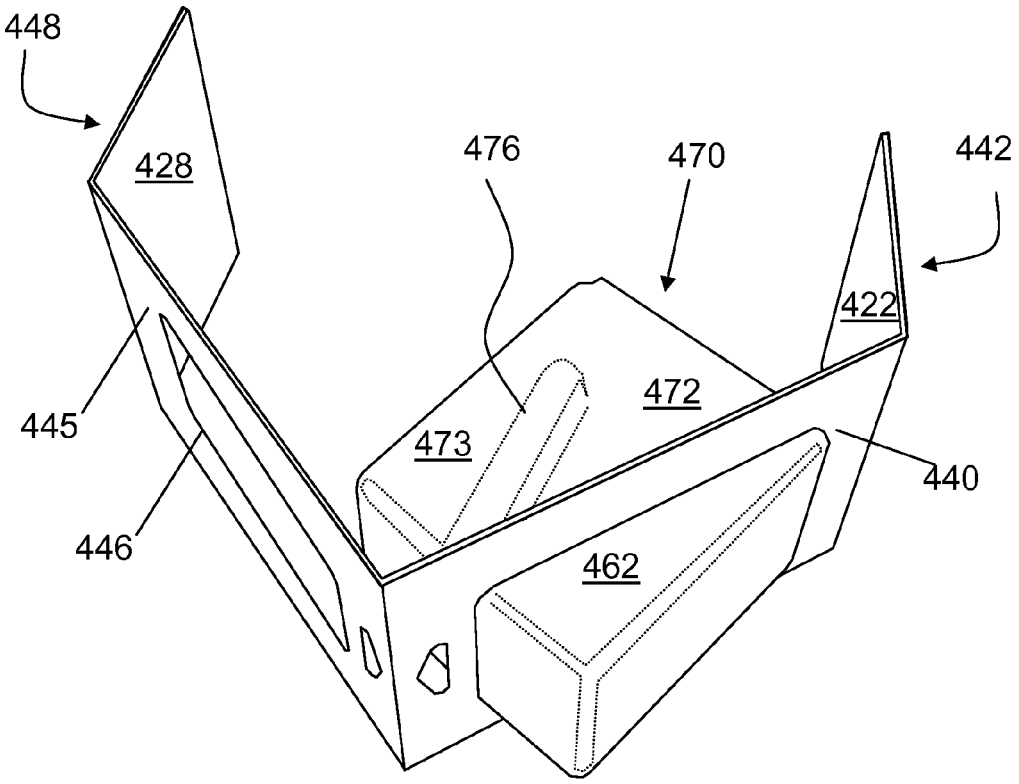
FIG. 4D is a top perspective view of the parts of FIG. 4A, in a stage of assembly.

As seen in FIG. 4C, the body 472 of the back blister 470 may extend through the "center" portion of the triangular shape. The body 472, depending on design, may not extend through aperture 426, 446 in extension 425, 445. However, narrowed portion 473 may extend through aperture 426, 446. Thus the triangular shape is limited from flexing inward. This may add strength to the package. Also to limit inward (our outward) flexing of the triangular shape, detent feature 475 may be provided which may engage the edge of aperture 426, 446. FIG. 4D shows an alternate embodiment, partly assembled, where a raised rib 476 may be provided on one or more sides of blister 470. When the paperboard panels are folded into the triangular shape, and front/back extension panel 425, 445 is folded around blister 470, a detent such as raised rib 476 may prevent aperture 446 from sliding excessively inward with respect to blister 470. The detent may also take other forms such as a groove, series of raised dimples, or other form to stop or restrict movement of the paperboard relative to the blister.

In another embodiment the package may be made of only one layer of paperboard. For example, front panel 440 and its attached panels may be omitted, and the blisters 460, 470 attached to one or both surfaces of back panel 420 by heat sealing, glue, staples, or other means. Alternately, back panel 420 and its attached panels may be omitted, and the blisters 460, 470 attached to one or both surfaces of front panel 440 by heat sealing, glue, staples, or other means.

Figure 5A:
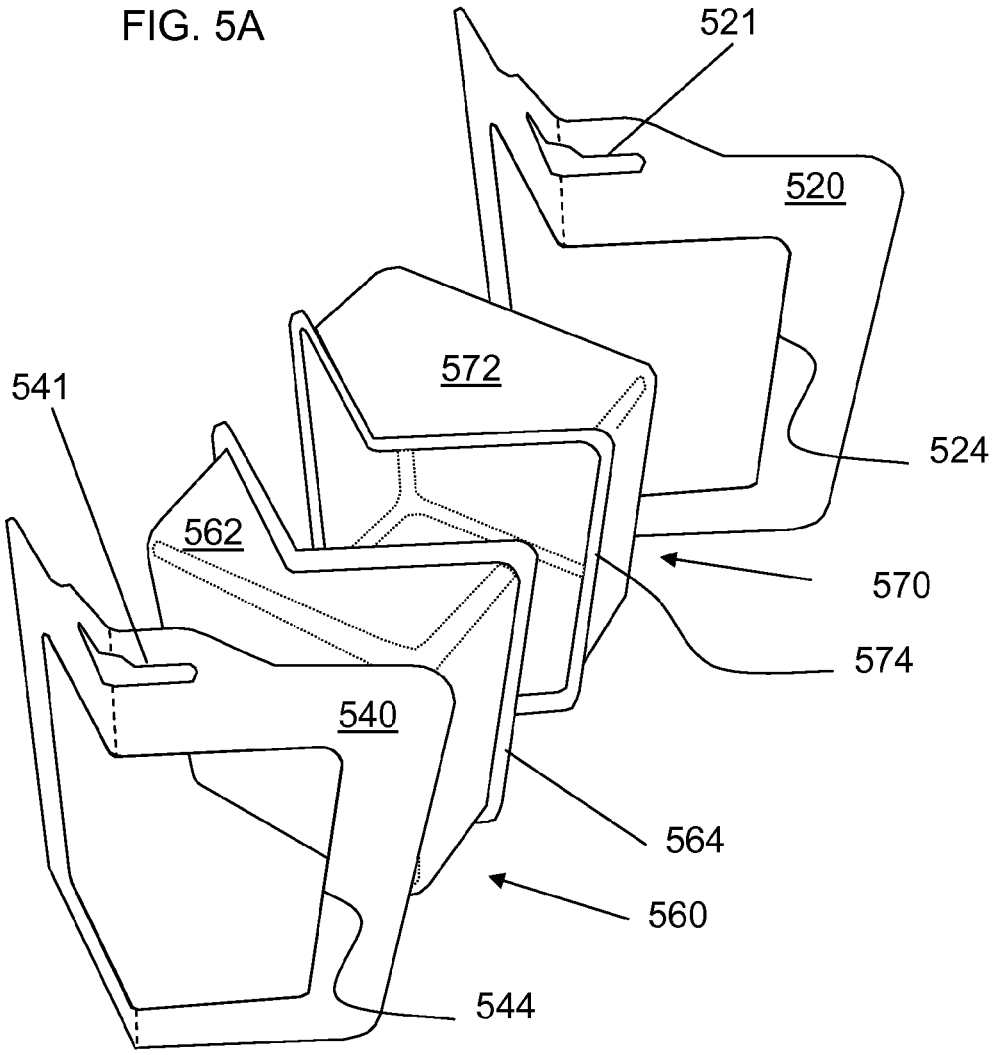
FIG. 5A is a top perspective view of the parts for another packaging structure.

FIG. 5A shows a front perspective view of parts for forming another standing package. The parts may include a back panel 520 that may comprise a fold, a front panel 540 that may also comprise a fold. The front and back panels may comprise hang holes 541, 521. The package may also comprise front blister 560, and back blister 570, the blisters having flanges 564, 574 with folded contours matching the folds in the front panel 540 and back panel 520. While the folds in FIG. 5A are triangular in cross section as viewed from above, other fold shapes such as "L", "Z", "W" may be utilized, as may a curved shape such as a "C" or "S" shape. The front panel 540 may have an aperture 544 to receive blister body 562. The back panel 520 may have an aperture 524 to receive blister body 572.

Figure 5B:
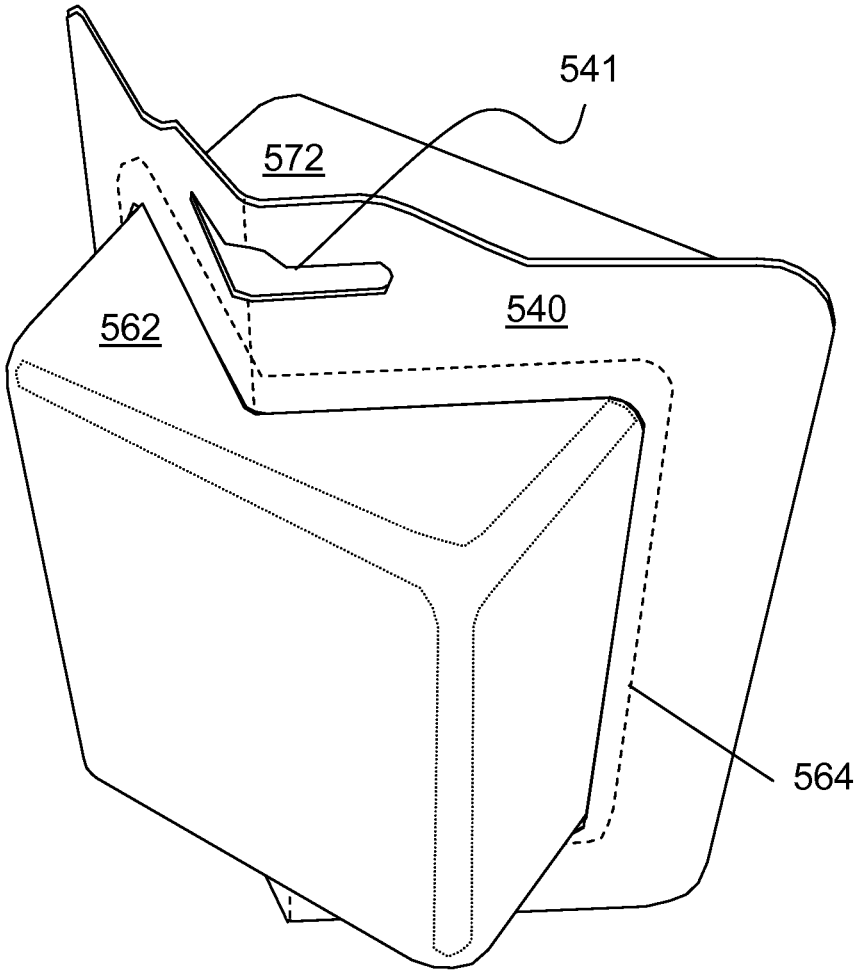
FIG. 5B is a top perspective view of a packaging structure made from the parts of FIG. 5A.

FIG. 5B shows a front perspective view of the package in an assembled configuration, with the blister flange 564 (and also blister flange 574) shown by dashed line sandwiched between front panel 540 (and also back panel 520). The folded "V" shape of the paperboard panels allows the package to stand upright. In one embodiment, the center of gravity of the package will fall within the "footprint" of the paperboard shape, thus providing a stable standing arrangement. Alternately the package may be displayed suspended by hang hole 541.

In another embodiment the package may be made of only one layer of paperboard. For example, front panel 540 may be omitted, and the blisters 560, 570 attached to one or both surfaces of back panel 520 by heat sealing, glue, staples, or other means. Alternately, back panel 520 may be omitted, and the blisters 560, 570 attached to one or both surfaces of front panel 540 by heat sealing, glue, staples, or other means.

Figure 6A:
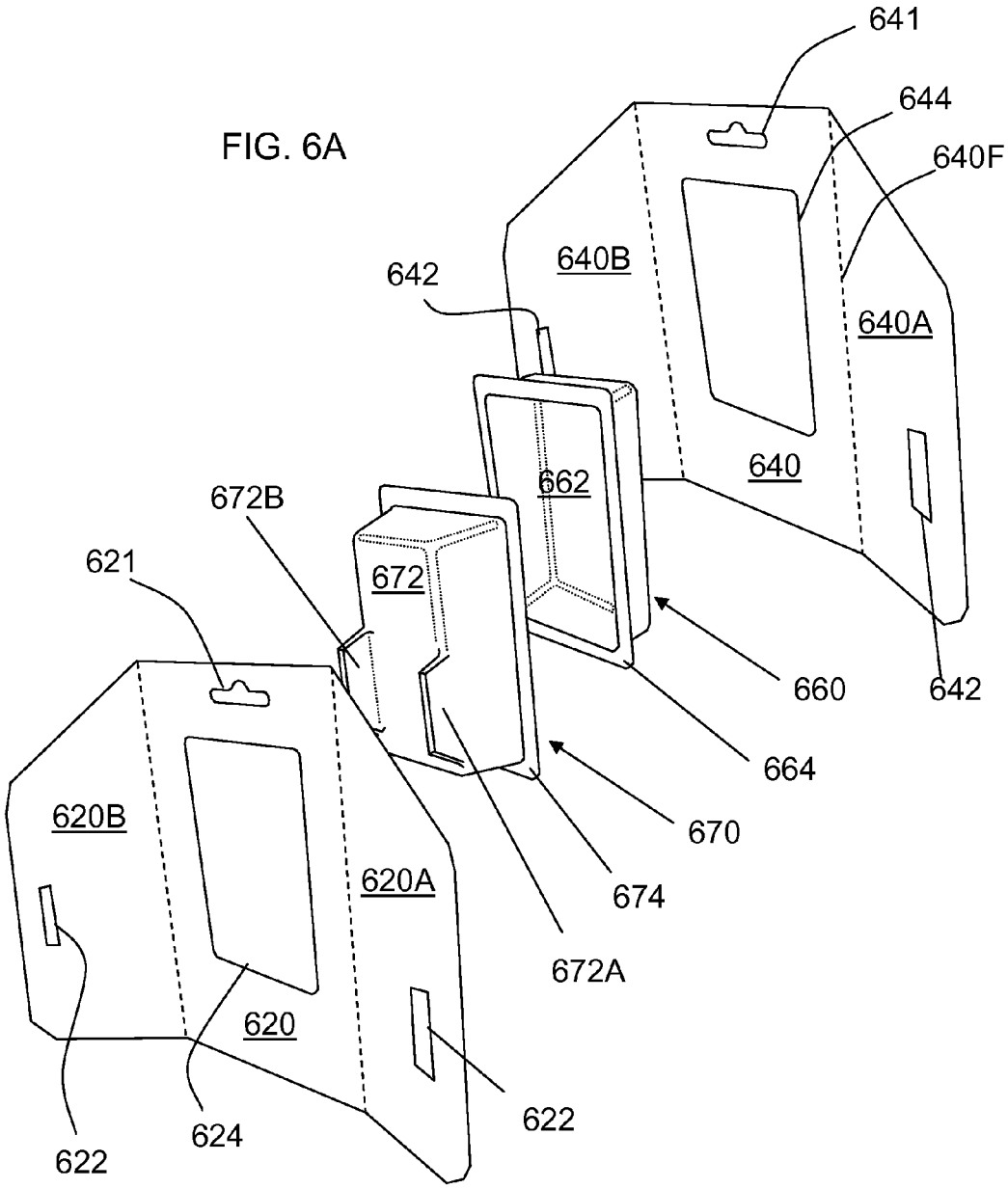
FIG. 6A is a back perspective view of the parts for another packaging structure.

FIG. 6A shows a back perspective view of parts for forming another standing package. The parts may include back panel 620 with back side panels 620A, 620B; front panel 640 with front side panels 640A, 640B. The parts may also include a front blister 660 with a blister body 662. The parts may further include a back blister 670 with blister body 672 and wing tabs 672A, 672B. One or both of the front and back panels may comprise a hang hole 641, 621. If both panels have a hang hole, they may overlap to reinforce the hang hole and the surrounding area. The front and back panel may be provided with fold, crease or score lines (generally shown, with fold line 640F enumerated as an example).

Blisters 660, 670 may be provided with blister flange 664, 674 that may be sandwiched from behind by back panel 620 and from in front by front panel 640. Apertures 624, 644 may be provided in back panel 620 and front panel 640 through which blisters 670, 660 respectively may protrude. Catch holes 622, 642 may be provided in the back panel 620 and front panel 640.

Figure 6B:
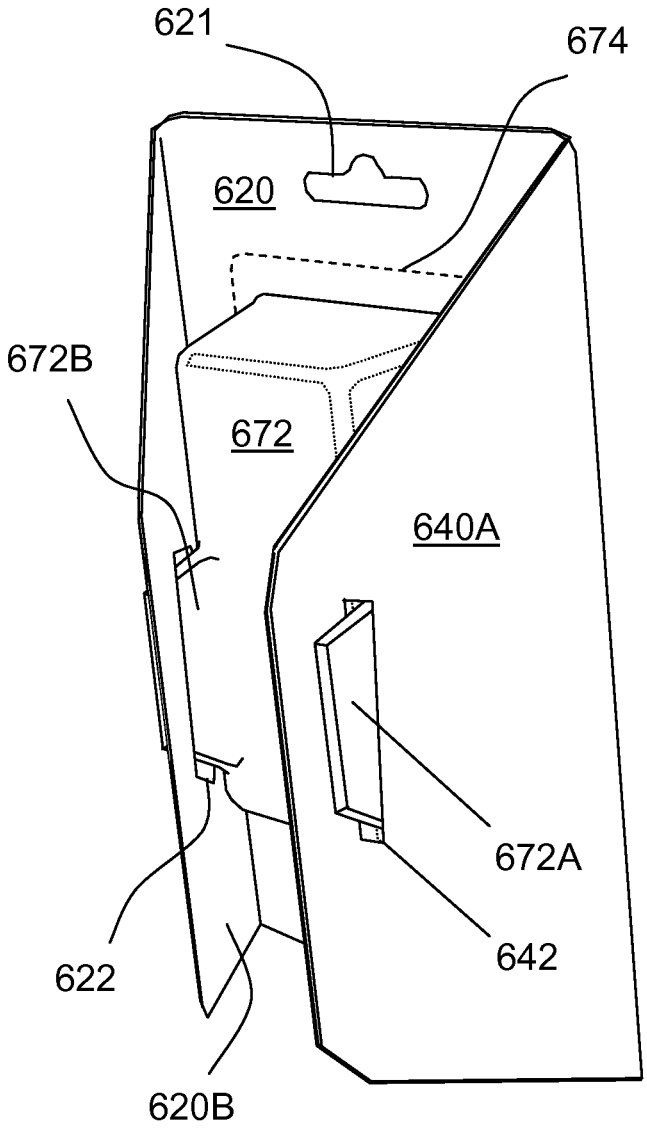
FIG. 6B is a back perspective view of a packaging structure made from the parts of FIG. 6A.

FIG. 6B shows the assembled package in back perspective view. The (now hidden) blister flange 674 is shown (dashed lines) sandwiched between the layers of the front panel and back panel. The front side panels 640A, 640B with their proximate back side panels 620A, 620B) have been folded back with respect to front panel 640 and its proximate back panel 620. Wing tabs 672A, 672B may be inserted through catch holes 622, 642 to retain the side panels in their folded configuration. The particular angle of the side panels to the front panel 640 and back panel 620 may be controlled by the design of blister 670 and its wing tabs 672A, 672B relative to the location of catch holes 622, 642. The design may be chosen so that the center of gravity of the finished package falls within the "footprint" defined by the front/back panel and the side panels. Thus the package will stand upright and stable. Alternately the package may be displayed hanging from hang hole 621.

In another embodiment the package may be made of only one layer of paperboard. For example, front panel 640 may be omitted, and the blisters 660, 670 attached to one or both surfaces of back panel 620 by heat sealing, glue, staples, or other means. Alternately, back panel 620 may be omitted, and the blisters 660, 670 attached to one or both surfaces of front panel 640 by heat sealing, glue, staples, or other means.

Figure 7A:
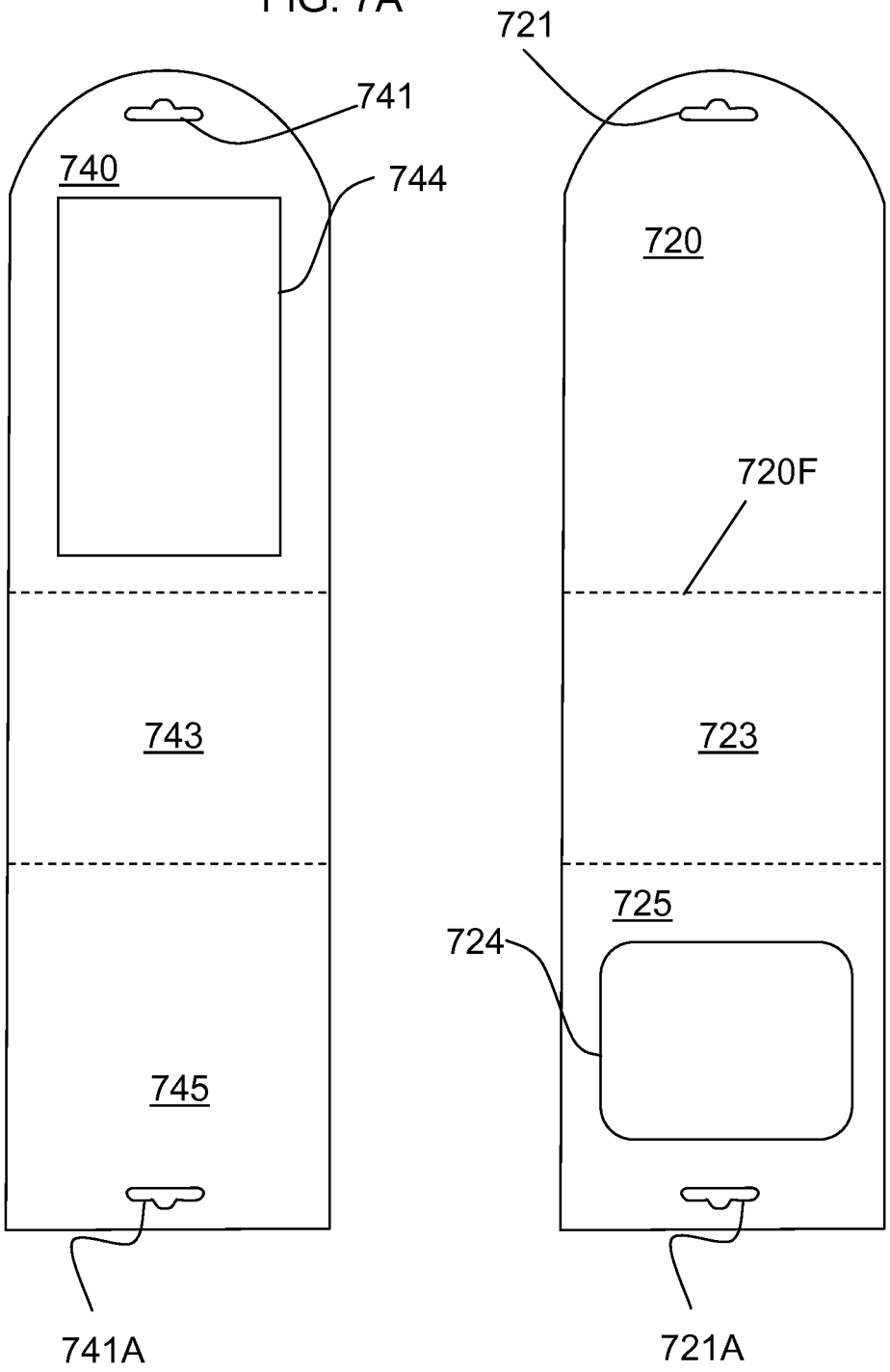
FIG. 7A is a top plan view of parts for another packaging structure.

FIG. 7A shows a plan view of blanks for another standing package. The blanks may include a front blank comprising a front upper panel 740, front middle panel 743, and front lower panel 745, and a back blank comprising a back upper panel 720, back middle panel 723, and back lower panel 725. These panels may be separated by fold or score lines, for example fold line 720F. The upper panels may comprise hang holes 721, 741 and the lower panels may comprise hang holes 721A, 741A. An upper aperture 744 may be provided in front upper panel 740. A lower aperture 724 may be provided in back lower panel 725. The front blank and the back blank may be separate parts as shown, or may be formed from a single sheet. During assembly the two blanks may be superimposed to form a two-layer package structure with blisters trapped between the layers, as previously described for the packages shown in FIGS. 1-6.

Figure 7B:
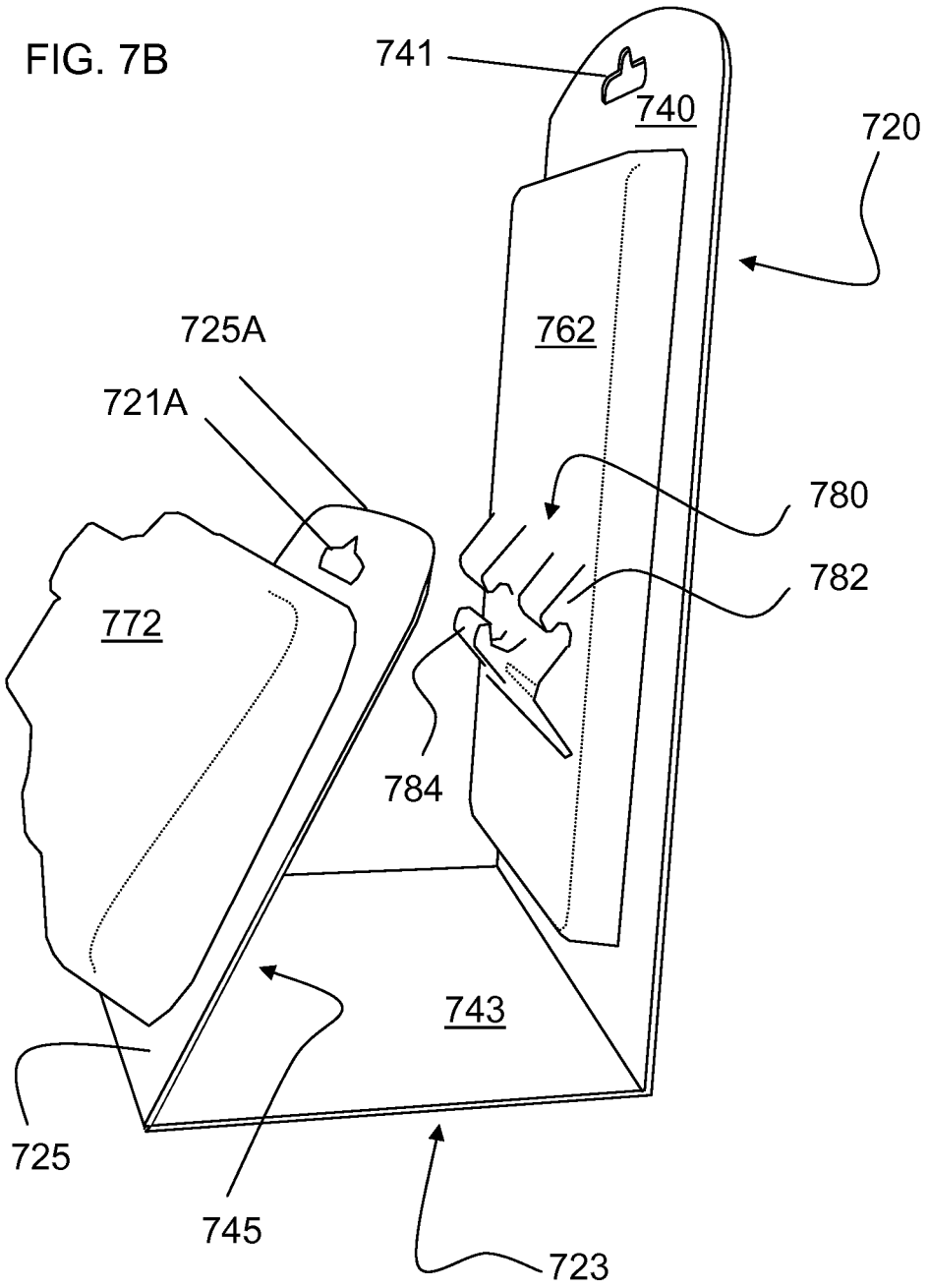
FIG. 7B is a side perspective view of the packaging structure made from the parts of FIG. 7A.
Figure 7C:
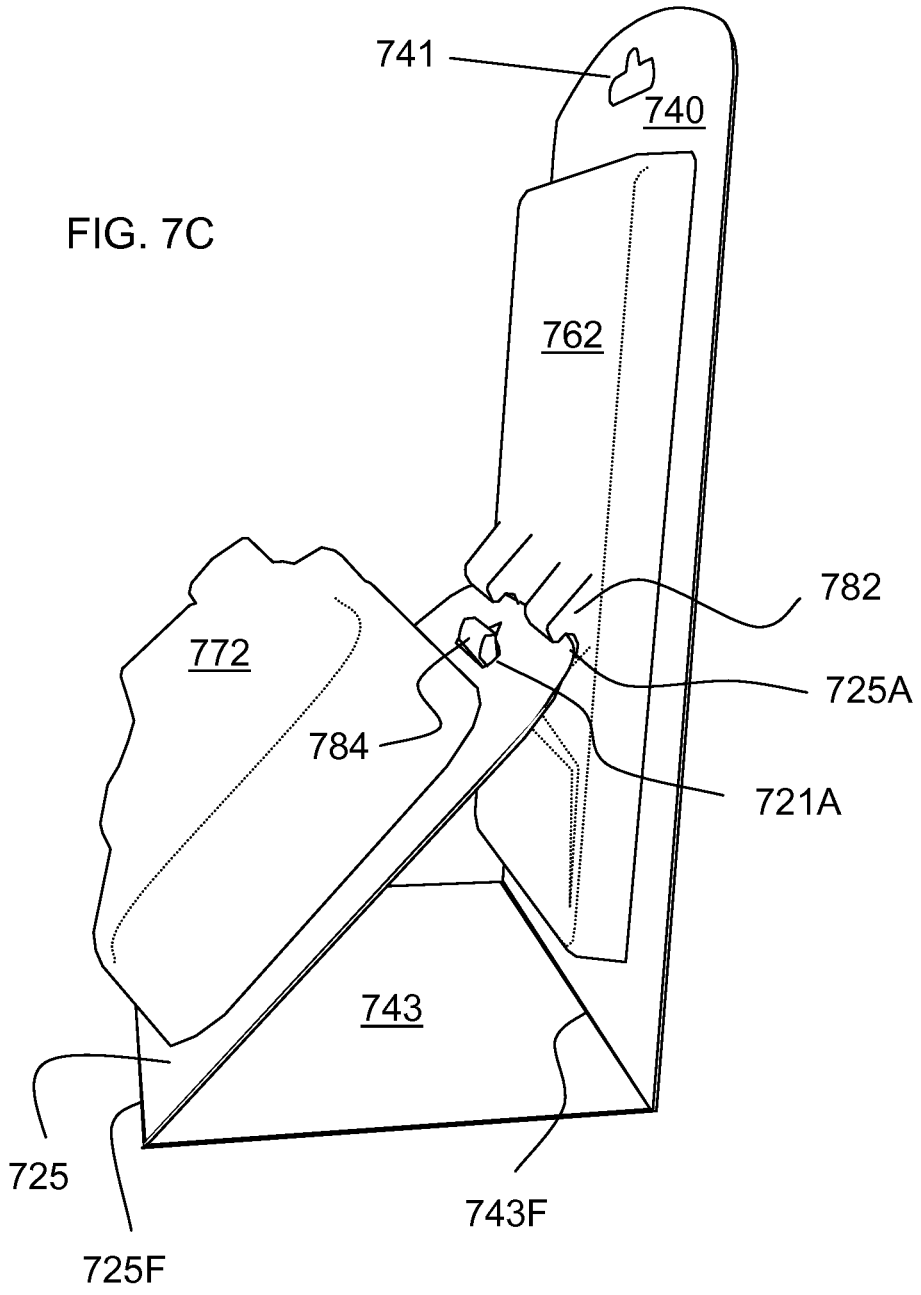
FIG. 7C is an alternate side perspective view of the packaging structure of FIG. 7B.

FIG. 7B shows a side perspective view of the package. An upper blister 762 may be placed in the upper aperture 744 and a lower blister 772 in the lower aperture 724. These blisters may be provided with flanges (not shown) that are sandwiched between the paperboard layers. From the viewpoint of the unassembled blanks shown in FIG. 7A, the upper blister would face forward (upward) and the lower blister would face backward (downward). The packaging structure may be folded into the shape seen in FIG. 7B, where the upper blister 762 faces forward, as does the lower blister 772. Upper blister 762 may for example house an item such as a DVD case, game cartridge, electronic module, or other item. Lower blister 772 may for example house an item such as a game controller, earphones, deck of cards, or other item. Upper blister 762 may be provided with a catch feature 780, such as one or more overlying fingers 782 that may catch the edge 725A of the lower panel, holding the package in a standing configuration. Upper blister 762 may also be provided with a catch feature such as hook 784 that may engage the hang hole 721A, holding the package in a standing configuration. FIG. 7C shows the overlying fingers 782 having caught edge 725A, and the hook 784 having engaged hang hole 721A. The package may be designed so that the center of gravity is located over the "footprint" occupied by middle panel 743, giving a stable standing package. Alternately the package may be displayed suspended from hang hole 741. The package may be separated into two parts, for example by tearing along line 743F or 725F, and then hanging the two parts from hang holes 721A and 741. If desired, the location of blister 772 may be "inside" the central triangular shape of the package. In such a case, if visibility into blister 772 is desired, a transparent "window" of plastic or blister material may be placed into the forward opening in back lower panel 725 (which faces forward in the configuration shown in FIGS. 7B and 7C).

In another embodiment the package may be made of only one layer of paperboard. For example, front panel 740 may be omitted, and the blisters 762, 772 each attached to an appropriate surface of back panel 720 (in this design, to opposite surfaces of the back panel) by heat sealing, glue, staples, or other means. In this case, lower aperture 724 may be omitted.

Alternately, back panel 720 may be omitted, and the blisters 762, 772 each attached to an appropriate surface of front panel 740 (in this design, to opposite surfaces of the front panel) by heat sealing, glue, staples, or other means. In this case, upper aperture 744 may be omitted.

Figure 8A:
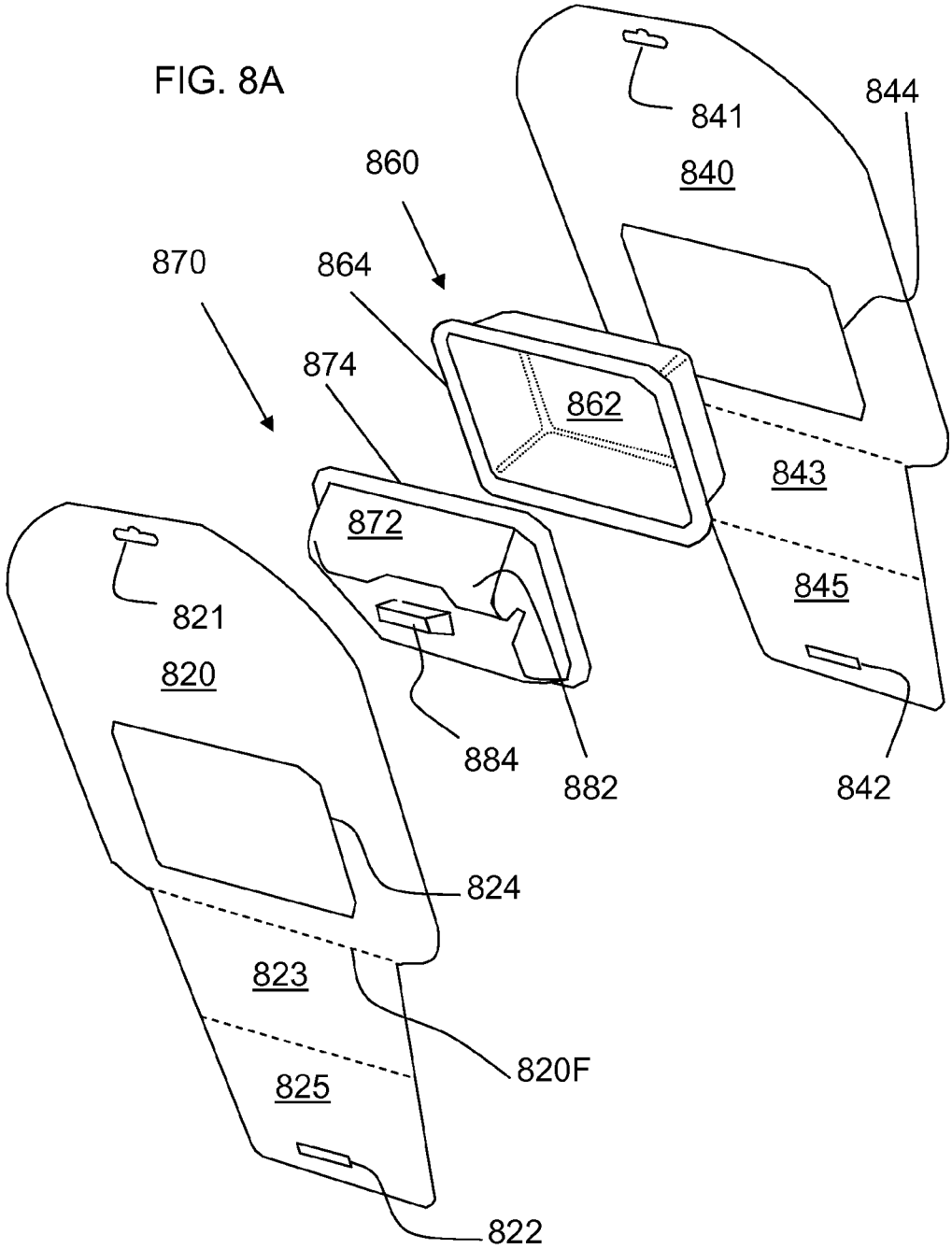
FIG. 8A is a back perspective view of the parts for another packaging structure.

FIG. 8A shows a back perspective view of blanks for another standing package. The blanks may include a front blank comprising a front upper panel 840, front middle panel 843, and front lower panel 845, and a back blank comprising a back upper panel 820, back middle panel 823, and back lower panel 825. These panels may be separated by fold or score lines, for example fold line 820F. The upper panels may comprise hang holes 821, 841 and the lower panels may comprise catch holes 822, 842. An aperture 844 may be provided in front upper panel 840, and an aperture 824 may be provided in back upper panel 820. The front blank and the back blank may be separate parts as shown, or may be formed from a single sheet. During assembly the two blanks may be superimposed to form a two-layer package structure with blisters trapped between the layers, as previously described for the packages shown in FIGS. 1-6. The body 862 of front blister 860 may protrude through aperture 844, with the blister flange 864 captured between the front upper panel 840 and back upper panel 820. The body 872 of back blister 870 may protrude through aperture 824, with the flange 874 captured between the back upper panel 820 and front upper panel 840. The back blister 870 may comprise one or more overhanging fingers 882 and one or more hooks 884.

Figure 8B:
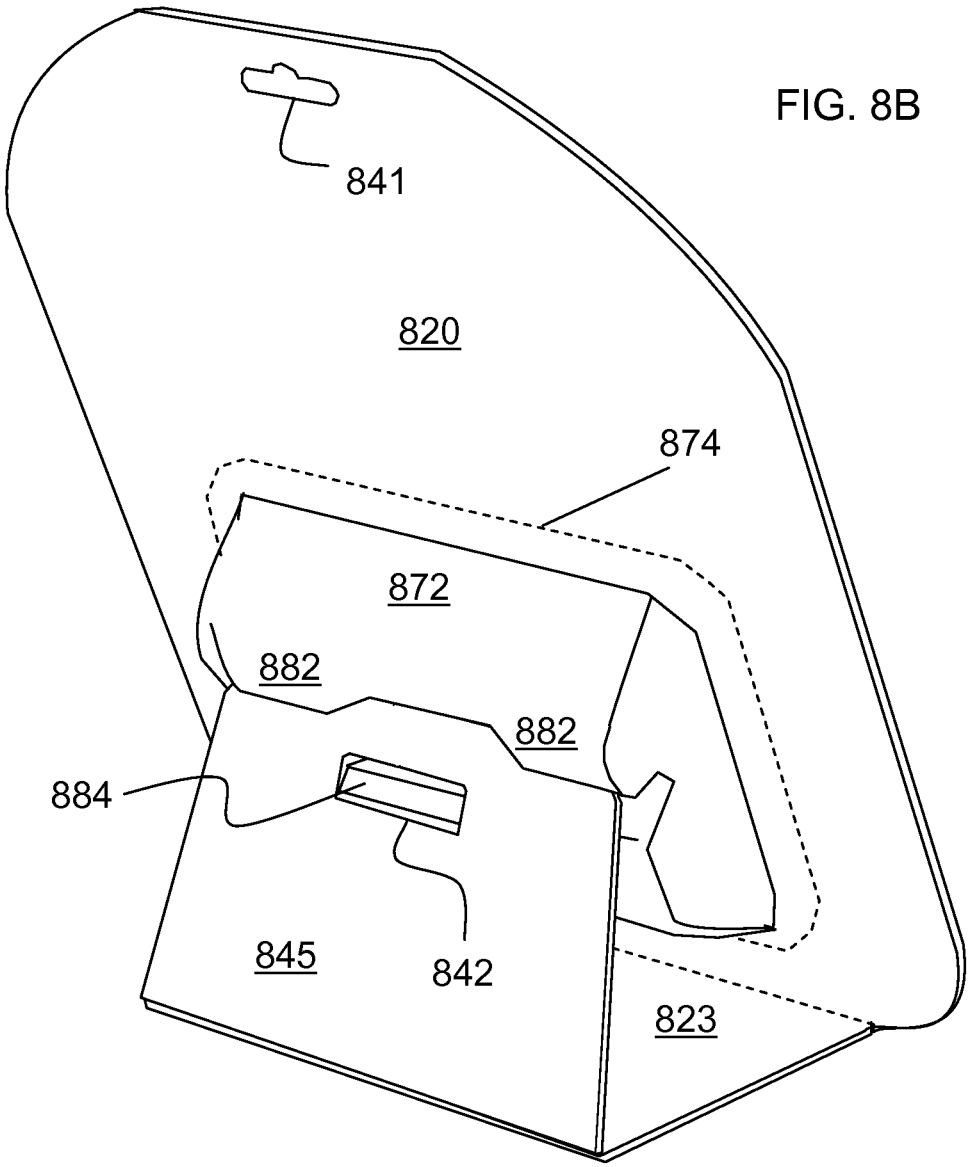
FIG. 8B is a back perspective view of a packaging structure made from the parts of FIG. 8A.

FIG. 8B shows a side perspective view of the package after assembly. The blister flanges, for example flange 874 as denoted by dashed line, are captured between the front upper panel 840 (obscured) and the back upper panel 820. The middle panels as denoted by back middle panel 823 are folded backward relative to the upper panels, and the lower panels as denoted by front lower panel 845 is then folded upward. This folds a self-standing structure. To retain the structure in the desired folded configuration, the lower panel 845 may be placed under overhanging fingers 882. To further help retain the folded configuration, catch hole 842 may engage hook 884.

The package may be designed so that the center of gravity is located over the "footprint" occupied by middle panel 823, giving a stable standing package. Alternately the package may be displayed suspended from hang hole 841. If desired, front blister 860 may be omitted and optionally replaced by a transparent "window" of plastic or blister material.

In another embodiment the package may be made of only one layer of paperboard. For example, front panel 840 may be omitted, and the blisters 860, 870 attached to one or both surfaces of back panel 820 by heat sealing, glue, staples, or other means. Alternately, back panel 820 may be omitted, and the blisters 860, 870 attached to one or both surfaces of front panel 840 by heat sealing, glue, staples, or other means.

Examples of materials and processes from which the exemplary packages may be formed are discussed in greater detail in U.S. Ser. No. 11/545,842 filed on Oct. 11, 2006, the entire contents of which are incorporated herein by reference.

The standing features described in this application may be used alone or in combination with other described standing features or security features. It is to be understood that a variety of materials may be used to form these packages. However, for sustainability purposes, a paperboard based material may be used and for improved theft deterrence a tear resistant paperboard may be used. Package materials may include tear-proof materials such as DURAFOLD paperboard, tear-resistant materials such as NATRALOCK paperboard, as well as other types of paperboard or plastic materials. The packages may be made of one or more layers of material, including but not limited to one, two, three or more layers of material. Different parts of the packages may comprise different materials and/or different numbers of layers.

The packages disclosed herein may be comprised mostly of paperboard, for example as described in International Application PCT/US08/051,245. The paperboard used in such packages may be tear-resistant as described in commonly assigned U.S. Pat. No. 7,144,635.

The packages disclosed herein may be made from one or several blanks (that is, the cut sheet parts from which the package components are made by folding and other steps). However, it should be understood that certain unitary blanks may be provided instead as more than one part, and certain blanks may be combined into single blanks, while still arriving at the same finished package.

Where more than one blank is used, the blanks may be assembled in various stages, including assembling a unitary blank into a package, assembling separate blanks and then joining them to form a package, and joining two or more blanks together, for example by heat sealing, gluing, mechanical fastening, or otherwise and then forming the combined blanks into the package.

It is to be understood that certain packages may be one continuous piece of material, and other packages may comprise two or more pieces of material. It is to be understood that a package may be heat sealed even where a heat sealed surface is in contact with a non-heat sealable surface. It is to be understood that in such a situation such an adhesion will strengthen the package, though it may not strengthen it as much as heat sealing between two heat sealable surfaces.

The packages described herein may be assembled in stages at various locations, for example partially constructing the package, moving or shipping it to one or more other locations, and completing the assembly of the package. For example, a package may be formed into a flattened or collapsible structure, then moved or shipped to another location for final forming, filling, and closure.

The packages may be shipped flat and erected when the product is filled or it may be shipped with the tray formed such that the heat sealing only needs to be performed at the edges of the package. It is to be understood that alternate sealing methods may be utilized depending upon manufacturing preferences, and that the package designs may still increase tear resistance in such a case, without the heat sealing. It is to be understood that using heat sealing with the package designs described herein may further increase the tear resistance of the packages.

Portions of the packages may be made of one, two, or more layers of material. It is to be understood that additional layers of material may be used based on manufacturing preferences. Portions of certain panels may be folded over or around the portions of other panels, creating multiple layers of material.

The packages may be provided with overt or hidden features to assist a customer in opening the package, as described in U.S. Provisional Application No. 61/025,102. Such opening features may be incorporated in any of the packages disclosed herein.

The packages may be provided with features to allow opening as described in U.S. Provisional Application 61/025,102. Such features, by way of example, may include overt or hidden weakened areas in the package. Such features may include a cut or nick in the periphery of the package, by which to initiate a tear. Such a tear initiation feature may be covered by a security device.

It should be understood that additional foldover panels may be included in the package blanks for further reinforcing the packages.

Those skilled in the art will appreciate that the disclosed blister packaging structures may provide a theft deterrent function at least for a few moments, while providing legitimate consumers with packages easy to open in a reasonably short time, for example using a pair of scissors and reducing the risk of injury as the scissors are less likely to slip on the NATRALOCK or paperboard like material than on the plastic blister pack.

To provide additional tear resistance protection, any of the materials used in these designs could be provided with overt or hidden features such as nicks, scores, perforations, holes, or other diverting features such that if a tear is initiated in the packaging material, it will not propagate in a direction more likely to breach the package, but may be rerouted by the diverting feature or features in a direction less likely to breach the package Alternately the diverting feature may stop the tear, slow the progression of the tear, or cause it to take a meandering path, thus lengthening the time it may take to eventually breach the package, and thereby discouraging a thief. Certain tear-diverting features are described in U.S. Provisional Application No. 61/081,404.

It is to be understood that a variety of standing features or a variety of hanging features may be used on any of these package designs as determined by manufacturing preferences. One or more reinforcing layers of paperboard or other material may be placed between layers of a package, for example between the front and back panels of a card-type package, for example at the hang hole location, as described in PCT/US08/066,517. The packages may be made to stand upright, either by their general shape, or for example by providing "feet" on the lower portion of blister 160, as described in International Application PCT/US06/030280. Although various aspects of the disclosed blister packaging structures have been shown and described, modifications may occur to those skilled in the art upon reading the specification.

The invention claimed is:

1. A packaging structure comprising:

a first panel comprised of sheet material, a first blister comprising a flange;

wherein the first blister is attached to the first panel, and one or more additional panels, said one or more additional panels foldably connected in series to said first panel;

wherein the blister comprises a first holding feature that receives an edge of at least one additional panel, and a second holding feature that engages an opening in the at least one additional panel;

wherein said one or more additional panels comprise at least second and third panels foldably attached together, wherein the first holding feature engages an edge of the third panel, thereby holding the first panel at a first angle relative to one of the other panels.

2. The packaging structure of claim 1, wherein a second layer of sheet material is attached to at least one of the panels, and the flange is attached between the at least one panel and the second layer of sheet material.

3. The packaging structure of claim 1, wherein the first panel comprises a first aperture through which the blister extends and wherein the packaging structure further comprises a second blister, wherein the second blister extends through a second aperture located on a panel other than said first panel.

4. The packaging structure of claim 1, wherein the blister is sealed to the first panel and not sealed to any additional panel, and at least one additional panel is folded out of the plane of the first panel.

5. The packaging structure of claim 1, wherein the first holding feature comprises at least one of a tab, finger, hook, detent, rib, groove, dimple, and catch.

6. The packaging structure of claim 1, wherein the second panel is located between the first and third panels.

7. The packaging structure of claim 1, wherein the blister further comprises a third holding feature to receive the edge of at least one additional panel, the third holding feature being spaced apart from the first holding feature, and the opening in the at least one additional panel is located between the first and third holding features and spaced away from the edge.

8. The packaging structure of claim 1, wherein the sheet material comprises paperboard.

9. The packaging structure of claim 1, wherein the blister comprises plastic.

* * * * *